US006736479B2

(12) United States Patent
Baba et al.

(10) Patent No.: US 6,736,479 B2
(45) Date of Patent: May 18, 2004

(54) INK JET RECORDING APPARATUS

(75) Inventors: Koichi Baba, Osaka (JP); Koji Ikeda, Hyogo (JP); Koji Matsuo, Fukuoka (JP); Masashi Tomita, Kumamoto (JP); Masaharu Oyama, Fukuoka (JP); Masaichiro Tatekawa, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 30 days.

(21) Appl. No.: 10/264,984

(22) Filed: Oct. 4, 2002

(65) Prior Publication Data

US 2003/0071869 A1 Apr. 17, 2003

(30) Foreign Application Priority Data

Oct. 5, 2001 (JP) ..... 2001-310546

(51) Int. Cl.[7] ..... B41J 29/393; B41J 2/045

(52) U.S. Cl. ..... 347/19; 347/68; 347/70; 347/71; 347/72

(58) Field of Search ..... 347/19, 14, 23, 347/10, 11, 12, 5, 20, 17, 71, 68, 70, 72; 73/777

(56) References Cited

U.S. PATENT DOCUMENTS 5,790,156 A * 8/1998 Mutton et al. ..... 347/71

FOREIGN PATENT DOCUMENTS

JP 05016359 A 1/1993
JP 11277744 A 10/1999

* cited by examiner

*Primary Examiner*—Stephen D. Meier
*Assistant Examiner*—Charles Stewart, Jr.
(74) *Attorney, Agent, or Firm*—Harness, Dickey & Pierce, P.L.C.

(57) ABSTRACT

An ink jet recording apparatus includes: a head body provided with a nozzle and a pressure chamber; an actuator including a piezoelectric element and an electrode for applying a voltage across the piezoelectric element; and a driving circuit for supplying a driving signal to the electrode of the actuator. The driving circuit always supplies an auxiliary pulse signal in every printing cycle. When ink is to be discharged, the driving circuit supplies, after the auxiliary pulse signal is supplied, an ink discharge pulse signal for driving the actuator so that the ink is discharged and so that an ink meniscus vibration in the nozzle is resonant with that caused by the auxiliary pulse signal.

11 Claims, 11 Drawing Sheets

INK JET RECORDING APPARATUS

FIELD OF THE INVENTION

The present invention relates to an ink jet recording apparatus.

BACKGROUND OF THE INVENTION

An ink jet head for discharging ink by a piezoelectric effect of a piezoelectric element has been used in the art in a recording apparatus such as a printer, a facsimile, and a copier. An ink jet head of this type includes pressure chambers filled with ink, nozzles communicated to the pressure chambers, and piezoelectric actuators for applying a pressure on the ink in the pressure chambers. The recording apparatus is provided with a driving circuit for supplying a driving signal to the piezoelectric actuators. When discharging ink, a driving signal is supplied from the driving circuit to the piezoelectric actuator. The piezoelectric actuator receiving the driving signal applies a pressure on the ink in the pressure chamber so as to push out the ink through the nozzle. In this way, an ink droplet is discharged from the nozzle and lands on recording paper, thus forming a predetermined image, or the like, on the recording paper.

While a pulse signal is commonly used as the driving signal, the pulse signal needs to have a sufficient pulse width and a sufficient peak value in order to discharge ink. A pulse signal in which the pulse width or the peak value is too small is insufficient as an ink discharging signal. However, techniques for actively using such a small pulse signal for the purpose of improving the ink discharging performance have been proposed in the art. Specifically, such techniques use minute pulse signals such that ink is not discharged, as auxiliary pulse signals, in addition to ink discharge pulse signals for the purpose of improving the ink discharging performance.

For example, Japanese Laid-Open Patent Publication No. 11-277744 discloses a technique for driving an ink jet head capable of discharging three different types of ink droplets for forming small, medium and large dots, respectively, wherein an auxiliary pulse signal is applied so as to replace ink in the vicinity of a nozzle opening whose viscosity has been increased with ink in the pressure chamber having an appropriate viscosity only during a printing cycle in which ink is not to be discharged and a printing cycle in which a medium dot is to be formed.

Japanese Laid-Open Patent Publication No. 5-16359 discloses a technique for changing the discharged ink volume (i.e., the volume of ink discharged in a single shot), in which an auxiliary pulse signal is applied before the application of an ink discharge pulse signal, and then an ink discharge pulse signal is applied so that the period thereof is matched with that of the residual pressure wave created by the auxiliary pulse signal.

However, in the ink jet head disclosed in Japanese Laid-Open Patent Publication No. 11-277744, the auxiliary pulse signal for preventing an increase in viscosity is applied selectively during some of the printing cycles so that the auxiliary pulse signal does not hinder the ink discharging operation. Specifically, if there is only a short interval between an auxiliary pulse signal and an ink discharge pulse signal, the residual vibration caused by the auxiliary pulse signal affects the ink discharge. Therefore, the application of the auxiliary pulse signal is restricted to a printing cycle in which ink is not to be discharged and a printing cycle for forming a medium dot, in which a long interval is ensured between the auxiliary pulse signal and the ink discharge pulse signal. This requires a circuit for turning ON/OFF the application of the auxiliary pulse signal, thus resulting in a complicated control and increasing the cost of the control circuit.

In the ink jet head disclosed in Japanese Laid-Open Patent Publication No. 5-16359, the auxiliary pulse signal is a signal that is applied for the purpose of changing the discharged ink volume, and the auxiliary pulse signal is not applied during a printing cycle in which no ink discharge pulse signal is applied. Therefore, ink in the vicinity of the opening of a nozzle through which ink is not discharged for a number of printing cycles may have a considerably high viscosity, in which case it difficult to appropriately discharge an ink droplet from the nozzle in the next ink discharging operation. This leads to problems such as dot diameter variations and a failure to discharge ink.

SUMMARY OF THE INVENTION

The present invention has been made in view of the above, and has an object to improve the discharged ink volume and to prevent an increase in the viscosity of ink in the vicinity of a nozzle opening by using an inexpensive configuration.

An ink jet recording apparatus of the present invention includes: a head body provided with a nozzle and a pressure chamber, which is communicated to the nozzle and is filled with ink; an actuator provided in the head body and including a piezoelectric element and an electrode for applying a voltage across the piezoelectric element for applying a pressure on the ink in the pressure chamber; and a driving circuit for supplying an actuator driving signal to the electrode of the actuator, wherein: in every printing cycle, the driving circuit always supplies an auxiliary pulse signal for driving the actuator to a degree such that the ink is not discharged; and if an ink discharge instruction signal instructing an ink discharge is received, the driving circuit supplies, after the auxiliary pulse signal is supplied, an ink discharge pulse signal for driving the actuator so that the ink is discharged and so that an ink meniscus vibration in the nozzle is resonant with that caused by the auxiliary pulse signal.

Note that the term "resonance" is used herein in its broad sense to mean not only resonance at the resonance point, but also resonance within a predetermined range from the resonance point.

In this way, since the auxiliary pulse signal is always supplied irrespective of whether or not ink is to be discharged, it is possible to suppress an increase in the viscosity of ink even for those nozzles through which ink is not discharged for a long period of time. Moreover, since the ink meniscus vibration caused by the auxiliary pulse signal is resonant with that caused by the ink discharge pulse signal, the amount of flexural deformation of the actuator when discharging ink is increased from that in a case where the auxiliary pulse signal is not supplied. Therefore, the discharged ink volume is increased. In a case where the auxiliary pulse signal is applied after the application of the ink discharge pulse signal, it is necessary to provide a time interval after the application of the auxiliary pulse signal so that the residual vibration caused by the auxiliary pulse signal does not affect the following printing cycle. With this recording apparatus, however, the auxiliary pulse signal is applied before the application of the ink discharge pulse signal. Therefore, it is not necessary to take into consideration the influence of the auxiliary pulse signal on the following printing cycle. Thus, it is possible to shorten the printing cycle and to increase the print speed. Since it is not necessary to provide a circuit for turning ON/OFF the application of the auxiliary pulse signal, it is possible to reduce the cost of the driving circuit.

Another ink jet recording apparatus of the present invention includes: a head body provided with a nozzle and a pressure chamber, which is communicated to the nozzle and is filled with ink; an actuator provided in the head body and including a piezoelectric element and an electrode for applying a voltage across the piezoelectric element for applying a pressure on the ink in the pressure chamber; and a driving circuit for supplying an actuator driving signal to the electrode of the actuator, wherein: in every printing cycle, the driving circuit always supplies an auxiliary pulse signal for driving the actuator to a degree such that the ink is not discharged; if an ink discharge instruction signal instructing an ink discharge is received, the driving circuit supplies, after the auxiliary pulse signal is supplied, an ink discharge pulse signal for driving the actuator so that the ink is discharged; and a time T from a completion of the supply of the auxiliary pulse signal until a start of the supply of the ink discharge pulse signal is set to satisfy $n*Tc+Tc/4 \leqq T \leqq n*Tc+3Tc/4$, where Tc is a Helmholtz period of a head, and n is zero or a natural number.

The ink discharge pulse signal may be made up of a plurality of pulses.

In this way, an increase in the viscosity of ink is suppressed even for those nozzles through which ink is not discharged for a long period of time not only when forming small dots but also when forming medium dots. Thus, when forming medium dots, it is possible to obtain an effect as that obtained when forming small dots.

Each of the auxiliary pulse signal and the ink discharge pulse signal may be a pulse signal for driving the actuator so as to first depressurize, and then pressurize, the pressure chamber.

In this way, each of the auxiliary pulse signal and the ink discharge pulse signal is a pulse signal having a so-called "pull-push waveform". When such a signal is supplied, the volume of the pressure chamber first increases and then decreases, whereby an ink meniscus is first pulled into the nozzle, and then pushed back outward from the inside of the nozzle. This replaces ink in the vicinity of the nozzle opening, and discharges an ink droplet from the nozzle.

It is preferred that a time T from a completion of the supply of the auxiliary pulse signal until a start of the supply of the ink discharge pulse signal is set to satisfy $n*Tc+Tc/4 \leqq T \leqq n*Tc+3Tc/4$, where Tc is a Helmholtz period of a head, and n is zero or a natural number.

Note that the term "Helmholtz period of a head" as used herein refers to the natural period of the entire vibration system including the ink (an acoustic element), the actuator, etc.

In this way, the vibration caused by the auxiliary pulse signal is more likely to be resonant with that caused by the ink discharge pulse signal, thus increasing the discharged ink volume.

It is preferred that: a pulse width of the auxiliary pulse signal is set to be ¼ to ½ of a Helmholtz period of a head; and a peak value of the auxiliary pulse signal is set to be less than or equal to a value that is 0.6 times that of the ink discharge pulse signal.

In this way, the auxiliary pulse signal can be used as a signal that is very suitable for replacing ink in the vicinity of the nozzle opening without discharging an ink droplet.

The ink jet recording apparatus may further include: an ink jet head including at least the head body and the actuator; and a driving mechanism for relatively moving the ink jet head and a recording medium with respect to each other.

As described above, according to the present invention, it is possible to increase the discharged ink volume and to suppress an increase in the viscosity of ink in a nozzle. Therefore, it is possible to improve the ink discharging performance. For example, it is possible to prevent a non-uniformity in the print density in a solid print at the highest driving frequency, and to prevent a dot dropout or dot diameter variations during an initial ink discharging operation or during ink discharging operations at low driving frequencies. Moreover, since it is not necessary to provide a circuit for turning ON/OFF the application of the auxiliary pulse signal, it is possible to reduce the cost of the apparatus.

DESCRIPTION OF THE PREFERRED EMBODIMENTS

A preferred embodiment of the present invention will now be described with reference to the drawings.

Figure 1:
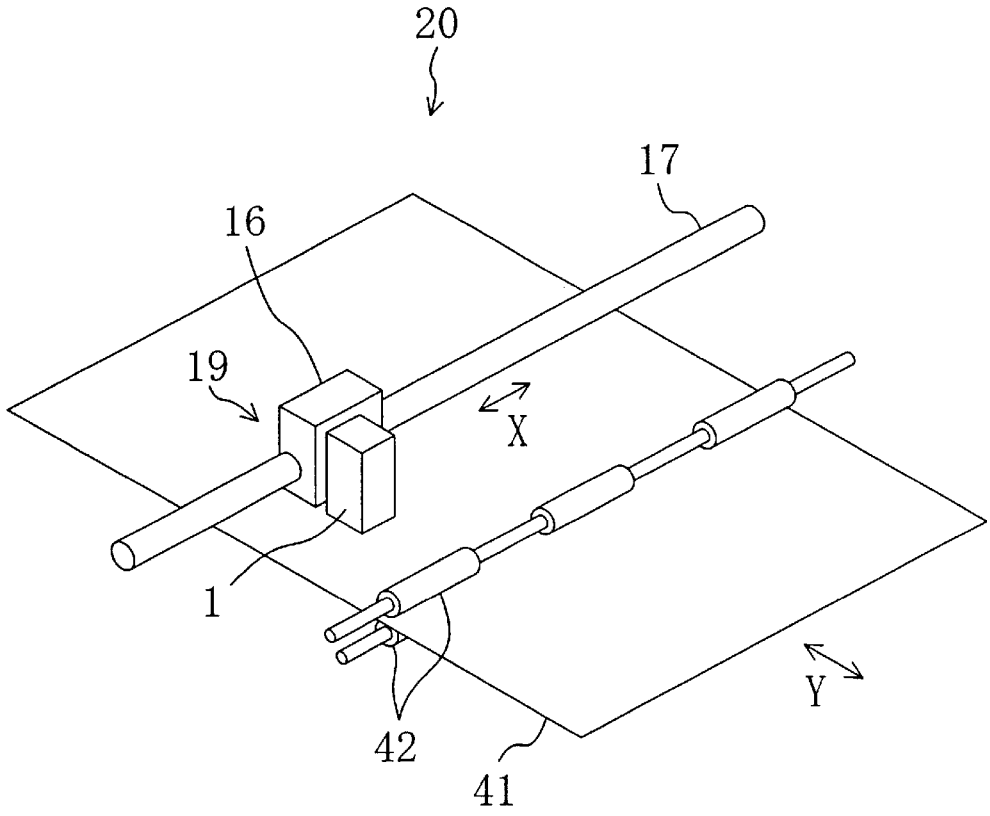
FIG. 1 is a diagram generally illustrating the configuration of a printer.
Figure 2:
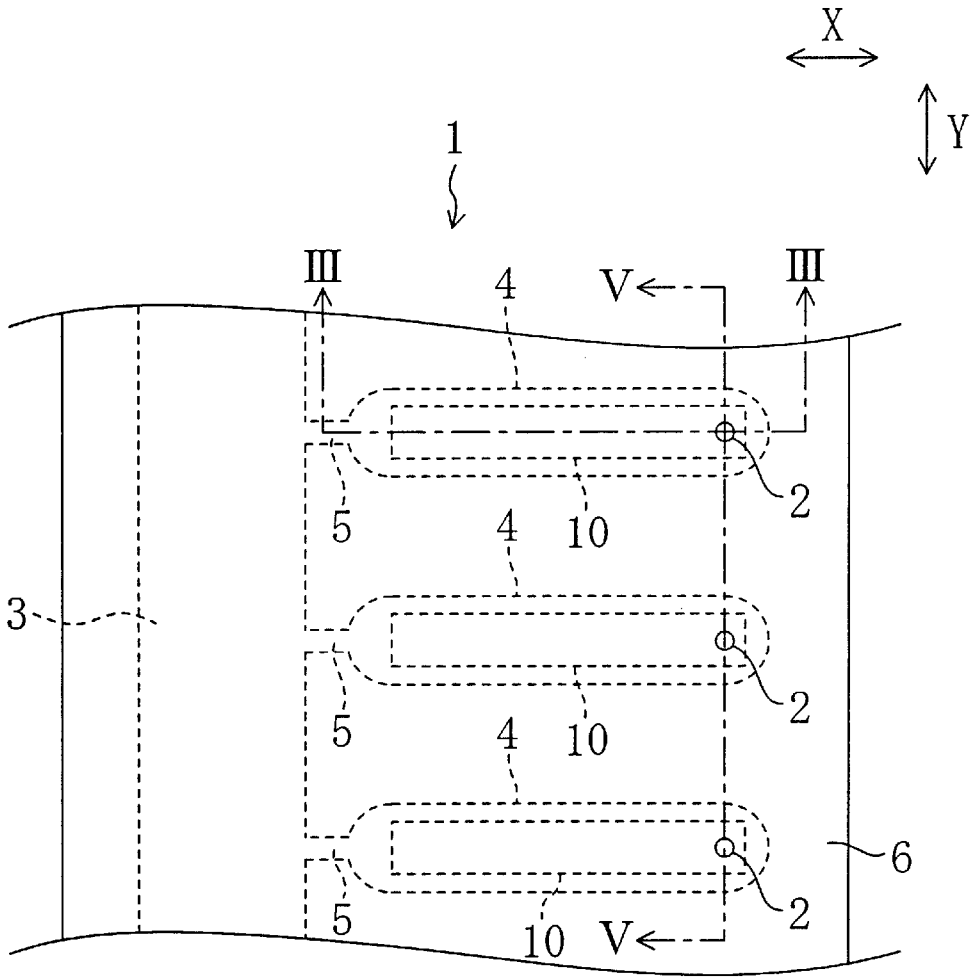
FIG. 2 is a plan view illustrating a part of an ink jet head.

FIG. 1 illustrates the general configuration of a printer 20 as an ink jet recording apparatus. The printer 20 includes an ink jet head 1 secured on a carriage 16. The carriage 16 is provided with a carriage motor (not shown). The carriage 16 is reciprocated by the carriage motor in the primary scanning direction (the X direction as shown in FIG. 1 and FIG. 2) while being guided by a carriage shaft 17 which extends in the primary scanning direction. The ink jet head 1, being mounted on the carriage 16, is reciprocated in the primary scanning direction X as the carriage 16 reciprocates. Note that the carriage 16, the carriage shaft 17 and the carriage motor together form a driving mechanism 19 for relatively moving the ink jet head 1 and recording paper 41 with respect to each other.

The recording paper 41 is sandwiched between two carrier rollers 42 which are rotated by a carrier motor (not shown), and is carried by the carrier motor and the carrier rollers 42 in the secondary scanning direction (the Y direction as shown in FIG. 1 and FIG. 2) which is perpendicular to the primary scanning direction X.

As illustrated in FIG. 2 to FIG. 5, the ink jet head 1 includes: a head body 40 which is provided with a plurality of pressure chambers 4 containing ink and a plurality of nozzles 2 communicated to the pressure chambers 4, respectively; and a plurality of actuators 10 for applying a pressure on the ink in the respective pressure chambers 4. The actuators 10 are so-called "flexural vibration type" actuators, which use the piezoelectric effect of piezoelectric elements 13. The actuators 10 discharge ink droplets from the nozzles 2 and fill the ink into the pressure chambers 4 by the change of the pressure in the pressure chambers 4 caused by contraction and expansion of the pressure chambers 4.

As illustrated in FIG. 2, the pressure chambers 4 are each formed in an elongate groove shape so as to extend in the primary scanning direction X in the ink jet head 1, and are arranged with respect to each other with a predetermined interval in the secondary scanning direction Y. The nozzle 2 is provided on one end (the right end in FIG. 2) of each pressure chamber 4. The nozzles 2 provide openings on the lower surface of the ink jet head 1 which are arranged with respect to each other with a predetermined interval in the secondary scanning direction Y. One end of each ink supply path 5 is connected to the other end (the left end in FIG. 2) of the pressure chamber 4, and the other end of each ink supply path 5 is connected to an ink supply chamber 3 which is provided so as to extend in the secondary scanning direction Y.

Figure 3:
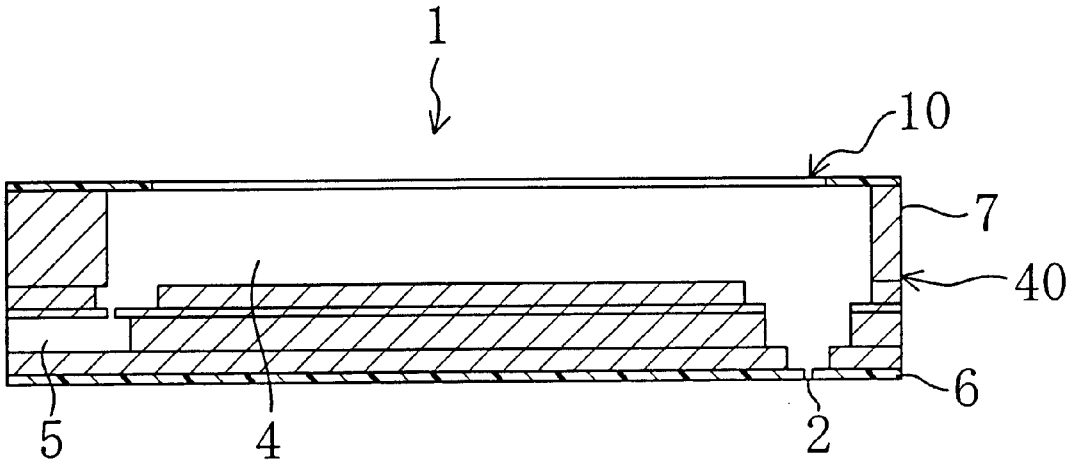
FIG. 3 is a cross-sectional view taken along line III—III of FIG. 2.

As illustrated in FIG. 3, the ink jet head 1 includes a nozzle plate 6 in which the nozzle 2 is formed, a partition wall 7 for partitioning the pressure chamber 4 and the ink supply path 5 from each other, and the actuator 10, which are deposited in this order. The nozzle plate 6 is a polyimide plate having a thickness of 20 $\mu$m, and the partition wall 7 is a laminate plate having a thickness of 480 $\mu$m, which is made of a stainless steel or of a stainless steel and a photosensitive glass.

Figure 4:
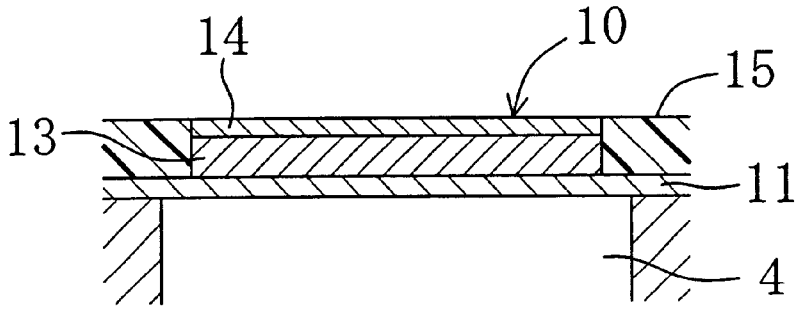
FIG. 4 is a cross-sectional view illustrating a part around an actuator.
Figure 5:
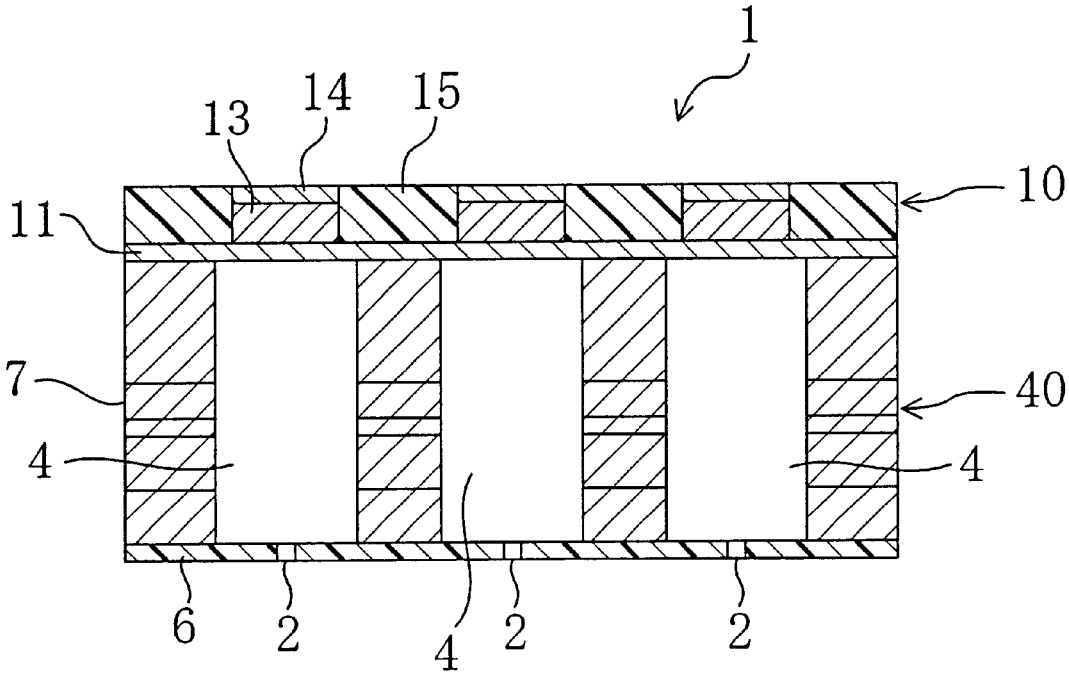
FIG. 5 is a cross-sectional view taken along line V—V of FIG. 2.

As illustrated in FIG. 4 and FIG. 5 in an exaggerated manner, the actuator 10 includes a vibration plate 11 covering the pressure chamber 4, the thin film piezoelectric element 13 for vibrating the vibration plate 11, and a separate electrode 14, which are deposited in this order. The vibration plate 11 is a chromium plate having a thickness of 2 $\mu$m, and also functions as a common electrode which, together with the separate electrode 14, applies a voltage across the piezoelectric element 13. The piezoelectric element 13 is provided for each pressure chamber 4. A PZT (lead zirconate titanate) plate having a thickness of 0.5 $\mu$m to 5 $\mu$m can be suitably used for the piezoelectric element 13. The piezoelectric element 13 of the present embodiment is a super thin piezoelectric element made of PZT having a thickness of 3 $\mu$m. The separate electrode 14 is made of a platinum plate having a thickness of 0.1 $\mu$m, and the total thickness of the actuators 10 is about 5 $\mu$m. Note that an electrically insulative layer 15 made of polyimide is provided between adjacent piezoelectric elements 13 and between adjacent separate electrodes 14.

Figure 6:
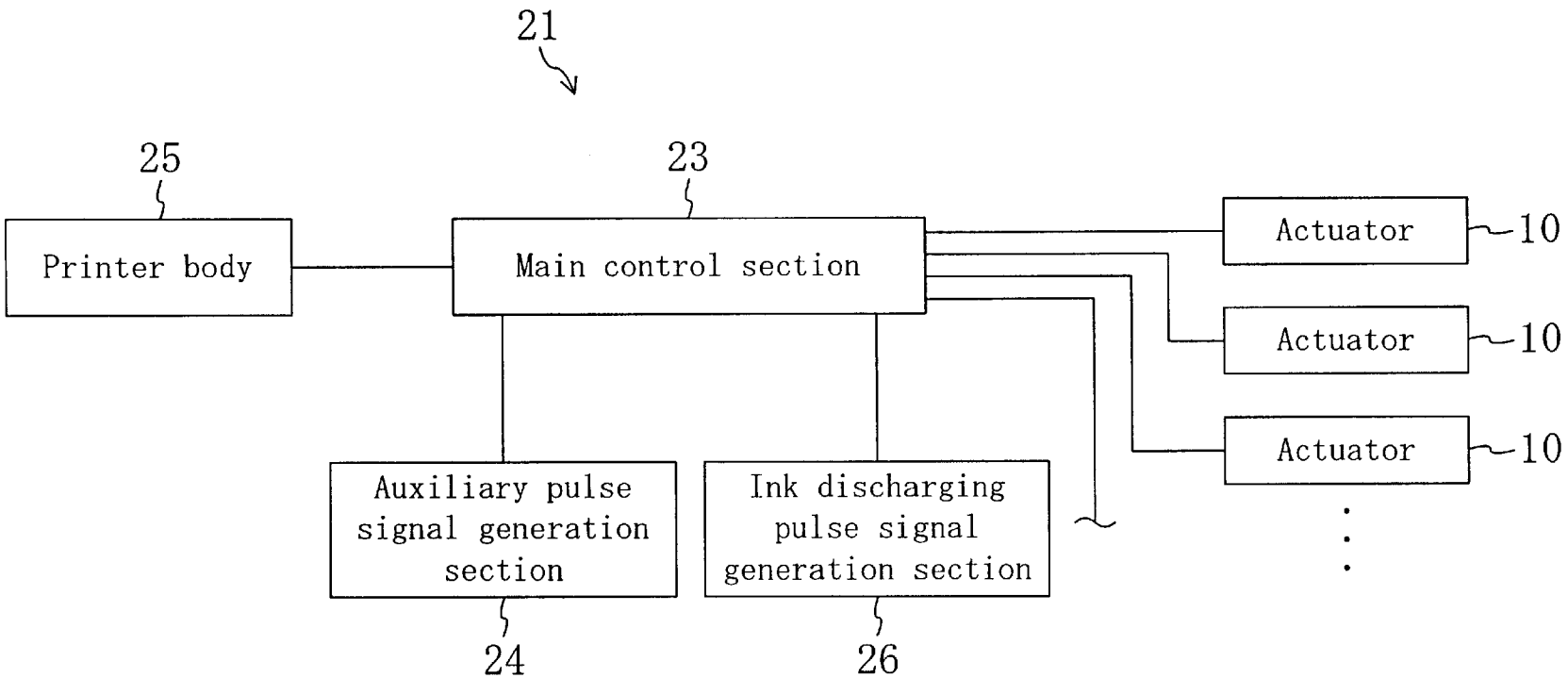
FIG. 6 is a block diagram schematically illustrating a control system.

As illustrated in FIG. 6, a driving circuit 21 for driving the ink jet head 1 includes an auxiliary pulse signal generation section 24 for generating an auxiliary pulse signal, an ink discharge pulse signal generation section 26 for generating an ink discharge pulse signal, and a main control section 23 for receiving a control signal (ink discharge instruction signal) from a printer body 25 so as to supply the ink discharge pulse signal to actuators 10 that are selected according to the control signal. In every printing cycle, the main control section 23 supplies the auxiliary pulse signal to all the actuators 10 and supplies the ink discharge pulse signal to the selected actuators 10, whereby ink droplets are discharged from nozzles that are associated with the selected actuators 10, thus forming a predetermined image on the recording paper 41.

Figure 7:
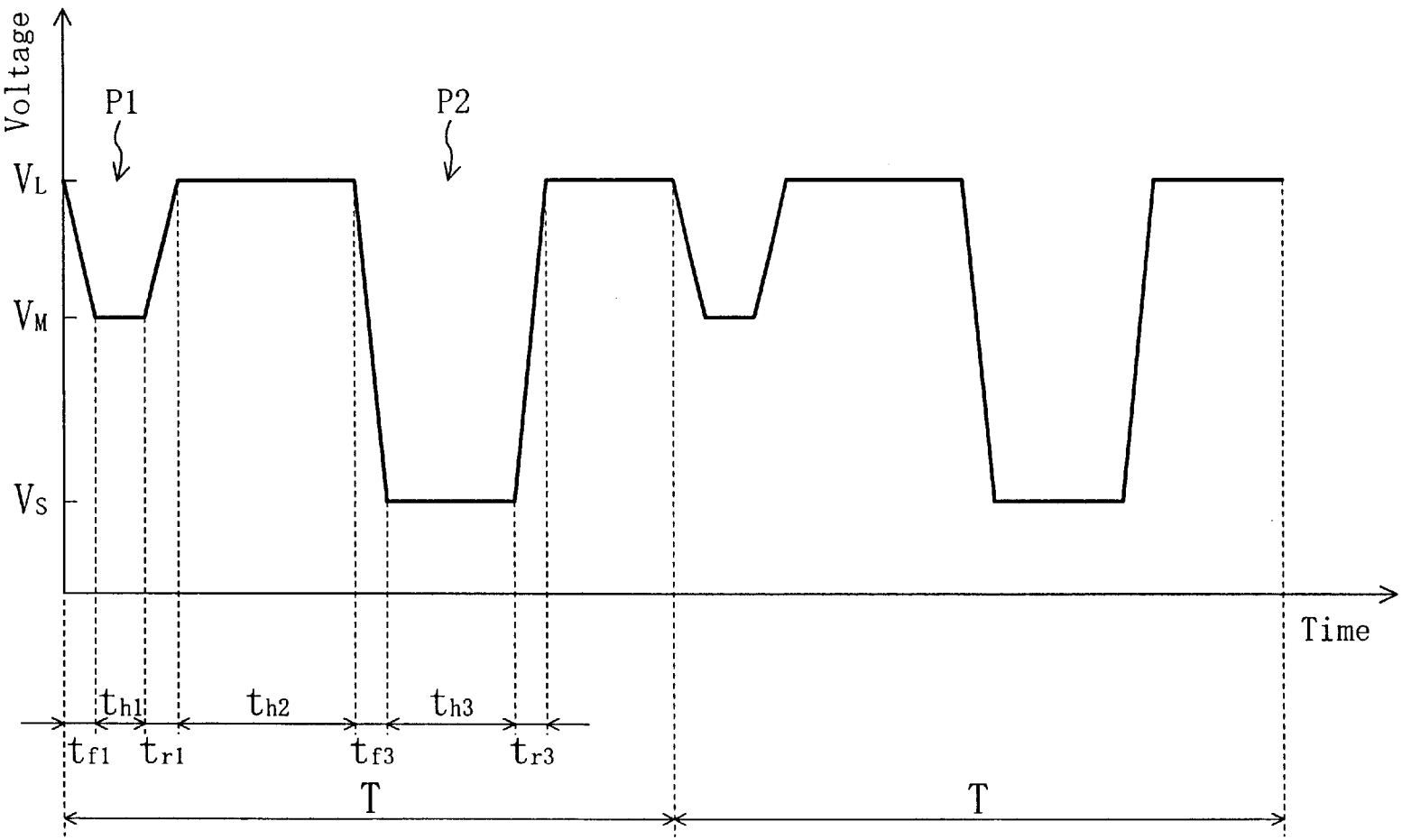
FIG. 7 is a waveform diagram illustrating a driving signal when ink is discharged.
Figure 8:
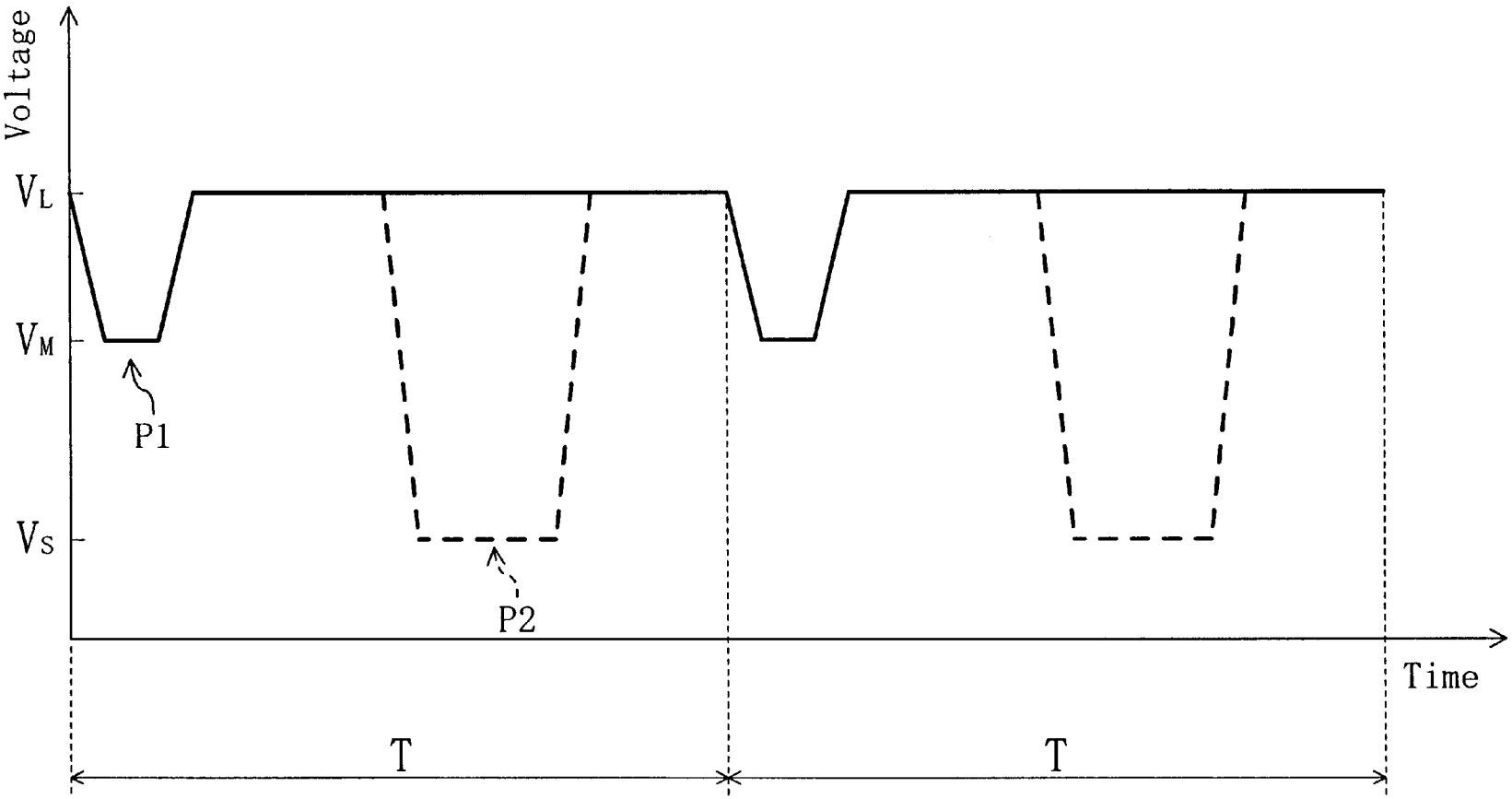
FIG. 8 is a waveform diagram illustrating a driving signal when ink is not discharged.

Next, the driving signal applied to the actuator 10 will be described with reference to FIG. 7 and FIG. 8. The driving signal is a signal that is applied in every printing cycle T, and includes an auxiliary pulse signal P1 and an ink discharge pulse signal P2.

The auxiliary pulse signal P1 is a signal that drives the actuator 10 so as to vibrate an ink meniscus to a degree such that ink in the vicinity of the opening of the nozzle 2 is replaced with ink in the nozzle 2 without discharging ink from the nozzle 2. The auxiliary pulse signal P1 is applied in every printing cycle T (see FIG. 7 and FIG. 8). In other words, the auxiliary pulse signal P1 is always applied irrespective of the presence/absence of the ink discharge pulse signal P2.

The ink discharge pulse signal P2 is a signal for driving the actuator 10 so as to discharge ink from the nozzle 2. The ink discharge pulse signal P2 is applied only in printing cycles in which ink is to be discharged (see FIG. 7), and is not applied in other printing cycles in which ink is not to be discharged (see FIG. 8).

Each of the auxiliary pulse signal P1 and the ink discharge pulse signal P2 is a signal that first depressurizes, and then pressurizes, the pressure chamber 4, and is a pulse signal having a so-called "pull-push waveform". In other words, each of the auxiliary pulse signal P1 and the ink discharge pulse signal P2 is a signal that makes the pressure chamber 4 once expand and then contract. The pulse signals P1 and P2 each include a potential decreasing waveform for decreasing the potential from a reference potential, a potential holding waveform for holding the decreased potential, and a potential increasing waveform for increasing the potential to the reference potential.

The pulse width of the auxiliary pulse signal P1 is set to be ¼ to ½ of the Helmholtz period Tc of the head. Note that the pulse width is herein defined as the time interval from the start of the potential decreasing waveform of the auxiliary pulse signal P1 to the end of the potential holding waveform thereof, and the Helmholtz period of the head herein refers to the natural period of the entire vibration system taking into account the influence of the actuators 10.

The pulse width of the auxiliary pulse signal P1 is set within a range as shown above for the following reason. That is, the effect of preventing an increase in the viscosity of ink cannot be obtained sufficiently if the pulse width is too small or too large. Another reason is as follows. As will be discussed later in greater detail, if the pulse width is too large or too small, the resonance between the ink meniscus vibration caused by the auxiliary pulse signal and that caused by the ink discharge pulse signal is decreased, whereby the amount of flexural deformation of the actuator is reduced from that in a case where a sufficient degree of resonance is being realized, thus reducing the discharged ink volume.

The peak value of the auxiliary pulse signal P1 ($=V_L-V_M$) is set to be less than or equal to a value that is 0.6 times that of the ink discharge pulse signal P2 ($=V_L-V_S$). This is because if the peak value of the auxiliary pulse signal P1 is too large, ink is discharged from the nozzle 2. Nevertheless, since the effect of preventing an increase in the viscosity of ink may not be obtained sufficiently with the peak value of the auxiliary pulse signal P1 being too small, the peak value of the auxiliary pulse signal P1 is preferably equal to or greater than a value that is 0.1 times that of the ink discharge pulse signal P2. Moreover, in order to sufficiently obtain the resonance effect to be described later, it is preferred that the peak value of the auxiliary pulse signal P1 is 0.2 to 0.4 times that of the ink discharge pulse signal P2.

The ink discharge pulse signal P2 is supplied at a timing such that the ink meniscus vibration caused by the auxiliary pulse signal P1 is resonant with that caused by the ink discharge pulse signal P2. Specifically, the ink discharge pulse signal P2 is supplied after passage of Tc/4 to 3Tc/4 from the application of the auxiliary pulse signal P1. Thus, the time interval $t_{h2}$ between the end of the potential increasing waveform of the auxiliary pulse signal P1 and the start of the potential decreasing waveform of the ink discharge pulse signal P2 is set to be 0.25 to 0.75 times the Helmholtz period Tc of the head. As will be discussed later in greater detail, while the degree of resonance is theoretically maximum when the time interval $t_{h2}$ is 0.5Tc, the effect of increasing the discharged ink volume can be obtained sufficiently as long as the time interval $t_{h2}$ is within 0.25Tc from 0.5Tc. Note that the time interval $t_{h2}$ is more preferably 0.3Tc to 0.7Tc, and yet more preferably 0.4Tc to 0.6Tc.

As described above, according to the present embodiment, the auxiliary pulse signal P1 is supplied in every printing cycle T irrespective of whether or not an ink droplet is to be discharged in that cycle. In this way, it is possible to prevent an increase in the viscosity of ink even for those nozzles through which ink is not discharged for a number of printing cycles. Therefore, it is possible to prevent problems such as a failure to discharge ink initially, and a dot dropout or dot diameter variations while the ink jet head is driven at low frequencies.

Moreover, the present embodiment eliminates the need to provide a circuit for turning ON/OFF the application of the auxiliary pulse signal P1, whereby it is possible to simplify the driving circuit and reduce the cost.

The auxiliary pulse signal P1 is supplied in an initial part of a printing cycle, and the vibration caused by the auxiliary pulse signal P1 is made resonant with the vibration caused by the ink discharge pulse signal P2. In this way, it is possible not only to prevent the ink discharging performance from being unstable due to the application of the auxiliary pulse signal P1, but also to increase the discharged ink volume. Therefore, it is possible to prevent a non-uniformity in the print density in a solid print at the highest driving frequency.

Since the discharged ink volume is increased, the margin for the pressure chamber 4 is also increased. In other words, the minimum volume of the pressure chamber 4 that is required for discharging a certain amount of ink drop is smaller than that in the prior art. Thus, with the discharged ink volume being equal, the size of the pressure chamber 4 can be reduced from that in the prior art. Therefore, it is possible to increase the density of the head and to reduce the cost of the head.

If the auxiliary pulse signal P1 is applied after the application of the ink discharge pulse signal P2, it is necessary to provide a time interval after the application of the auxiliary pulse signal P1 so that the residual vibration caused by the auxiliary pulse signal P1 does not affect the following printing cycle. In the present embodiment, however, the auxiliary pulse signal P1 is applied before the application of the ink discharge pulse signal P2. Therefore, it is not necessary to take into consideration the influence of the auxiliary pulse signal P1 on the following printing cycle. Thus, it is possible to shorten the printing cycle and to increase the print speed.

Three experiments were conducted in order to confirm the effect of increasing the discharged ink volume.

Experiment 1

Shown in Table 1 below are various parameters used in Experiment 1, including the maximum voltage $V_L$, the medium voltage $V_M$, the minimum voltage $V_S$, the falling time $t_{f1}$ of the auxiliary pulse signal P1, the peak hold time $t_{h1}$ of the auxiliary pulse signal P1, the rising time $t_{r1}$ of the auxiliary pulse signal P1, the time $t_{h2}$ between the auxiliary pulse signal P1 and the ink discharge pulse signal P2, the falling time $t_{f3}$ of the ink discharge pulse signal P2, the peak hold time $t_{h3}$ of the ink discharge pulse signal P2, the rising time $t_{r3}$ of the ink discharge pulse signal P2, and the printing cycle T. The pulse width, which is the sum of the falling time $t_{f1}$ and the peak hold time $t_{h1}$ of the auxiliary pulse signal P1 was set to 1.0 μs, 2.0 μs, 3.5 μs, 4.0 μs, 6.0 μs and 7.0 μs. Note that the Helmholtz period Tc of the head is 8 μs, and the driving frequency f(1/T) is 5 kHz.

TABLE 1

| Parameter | Value |
|---|---|
| $V_L$ | 26 V |
| $V_M$ | 5.2 V |
| $V_S$ | 0 V |
| $t_{f1}$ | 0.5 μs |
| $t_{h1}$ | 0.5, 1.5, 3, 3.5, 5.5, 6.5 μs |
| $t_{r1}$ | 0.5 μs |
| $t_{h2}$ | 4 μs |
| $t_{f3}$ | 0.5 μs |
| $t_{h3}$ | 3.6 μs |
| $t_{r3}$ | 0.5 μs |
| T | 200 μs |

Figure 9:
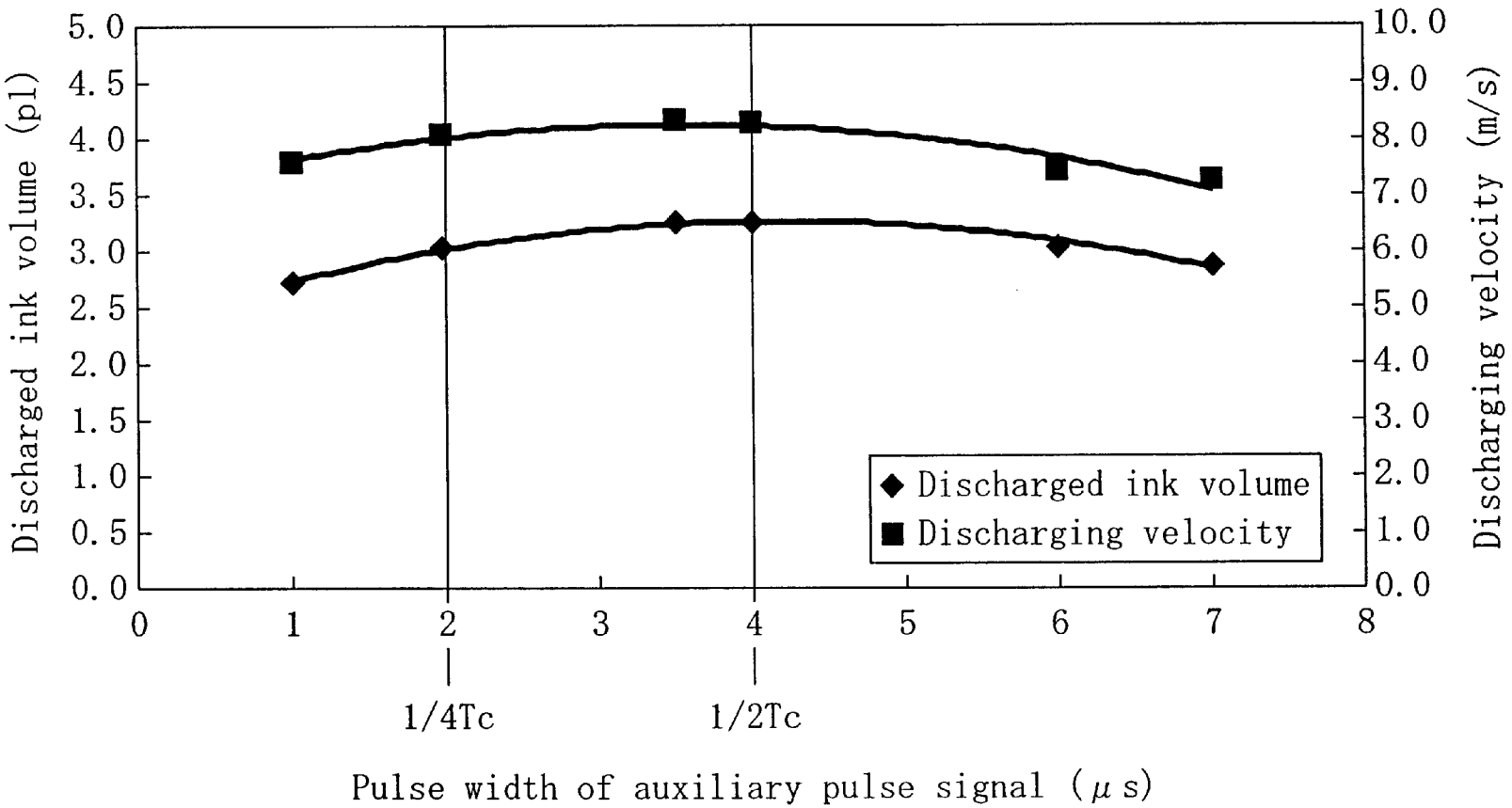
FIG. 9 is a graph illustrating the results of an experiment conducted for confirming the effect of increasing the discharged ink volume.

The results of the experiment are shown in FIG. 9. FIG. 9 is a graph in which the horizontal axis represents the pulse width of the auxiliary pulse signal P1, i.e., $t_{f1}+t_{h1}$, the first vertical axis represents the discharged ink volume, and the second vertical axis represents the ink droplet discharging velocity. It can be seen from FIG. 9 that the discharged ink volume and the ink droplet discharging velocity both peak at a pulse width that is about ½ of the Helmholtz period Tc. It can also be seen that the discharged ink volume and the ink droplet discharging velocity are both stable when the pulse width is ¼ to ½ of the Helmholtz period Tc. These results confirm the effect of the present embodiment.

Experiment 2

Shown in Table 2 below are various parameters used in Experiment 2. The parameters were set to the same values as in Experiment 1 except for the medium voltage $V_M$, which was set to 0, $0.2V_L$, $0.3V_L$, $0.4V_L$, $0.5V_L$ and $0.6V_L$.

TABLE 2

| Parameter | Value |
|---|---|
| $V_L$ | 26 V |
| $V_M$ | $V_L$ *(0 to 60%) |
| $V_S$ | 0 V |
| $t_{f1}$ | 0.5 μs |
| $t_{h1}$ | 3 μs |
| $t_{r1}$ | 0.5 μs |

TABLE 2-continued

| Parameter | Value |
|---|---|
| $t_{h2}$ | 4 μs |
| $t_{f3}$ | 0.5 μs |
| $t_{h3}$ | 3.6 μs |
| $t_{r3}$ | 0.5 μs |
| T | 200 μs |

Figure 10:
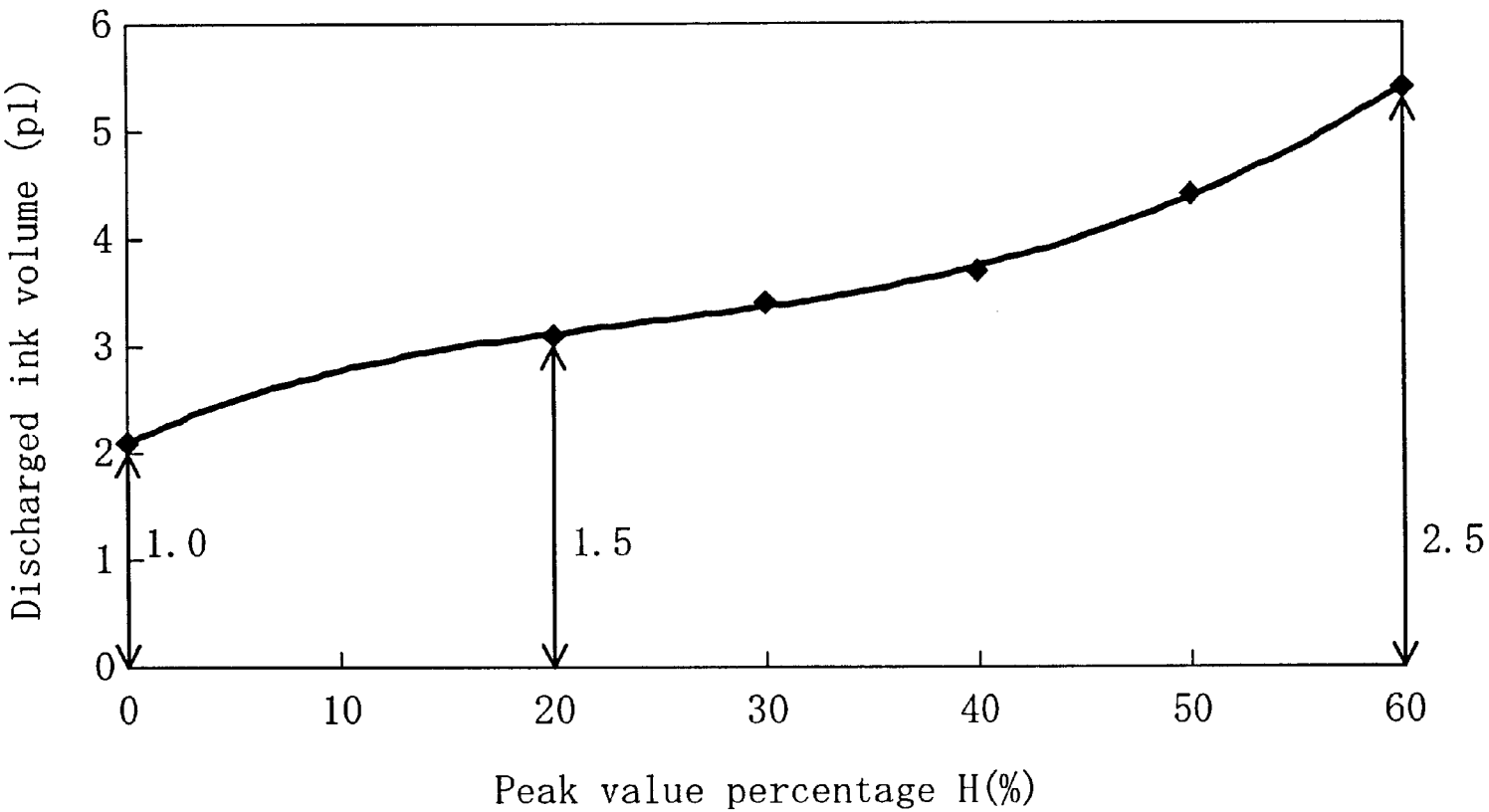
FIG. 10 is a graph illustrating the results of an experiment conducted for confirming the effect of increasing the discharged ink volume.

The results of the experiment are shown in FIG. 10. FIG. 10 is a graph in which the horizontal axis represents the percentage H (%) of the peak value of the auxiliary pulse signal P1 with respect to that of the ink discharge pulse signal P2, i.e., $H=(V_L-V_M)/(V_L-V_S)*100$, and the vertical axis represents the discharged ink volume. It can be seen from FIG. 10 that the discharged ink volume is increased by a factor of 1.5 or more when the percentage H is 20% or more and by a factor of about 2.5 when the percentage H is 60%. These results confirm the effect of the present embodiment.

Experiment 3

Shown in Table 3 below are various parameters used in Experiment 3. The parameters were set to the same values as in Experiment 1 except for the time $t_{h2}$ between the auxiliary pulse signal P1 and the ink discharge pulse signal P2, which was set to 0.125Tc, 0.25Tc, 0.3Tc, 0.4Tc, 0.5Tc, 0.6Tc, 0.7Tc, 0.75Tc and 0.875Tc.

TABLE 3

| Parameter | Value |
|---|---|
| $V_L$ | 26 V |
| $V_M$ | 5.2 V |
| $V_S$ | 0 V |
| $t_{f1}$ | 0.5 μs |
| $t_{h1}$ | 3 μs |
| $t_{r1}$ | 0.5 μs |
| $t_{h2}$ | 1, 2, 2.4, 3.2, 4, 4.8, 5.6, 6, 7 μs |
| $t_{f3}$ | 0.5 μs |
| $t_{h3}$ | 3.6 μs |
| $t_{r3}$ | 0.5 μs |
| T | 200 μs |

Figure 11:
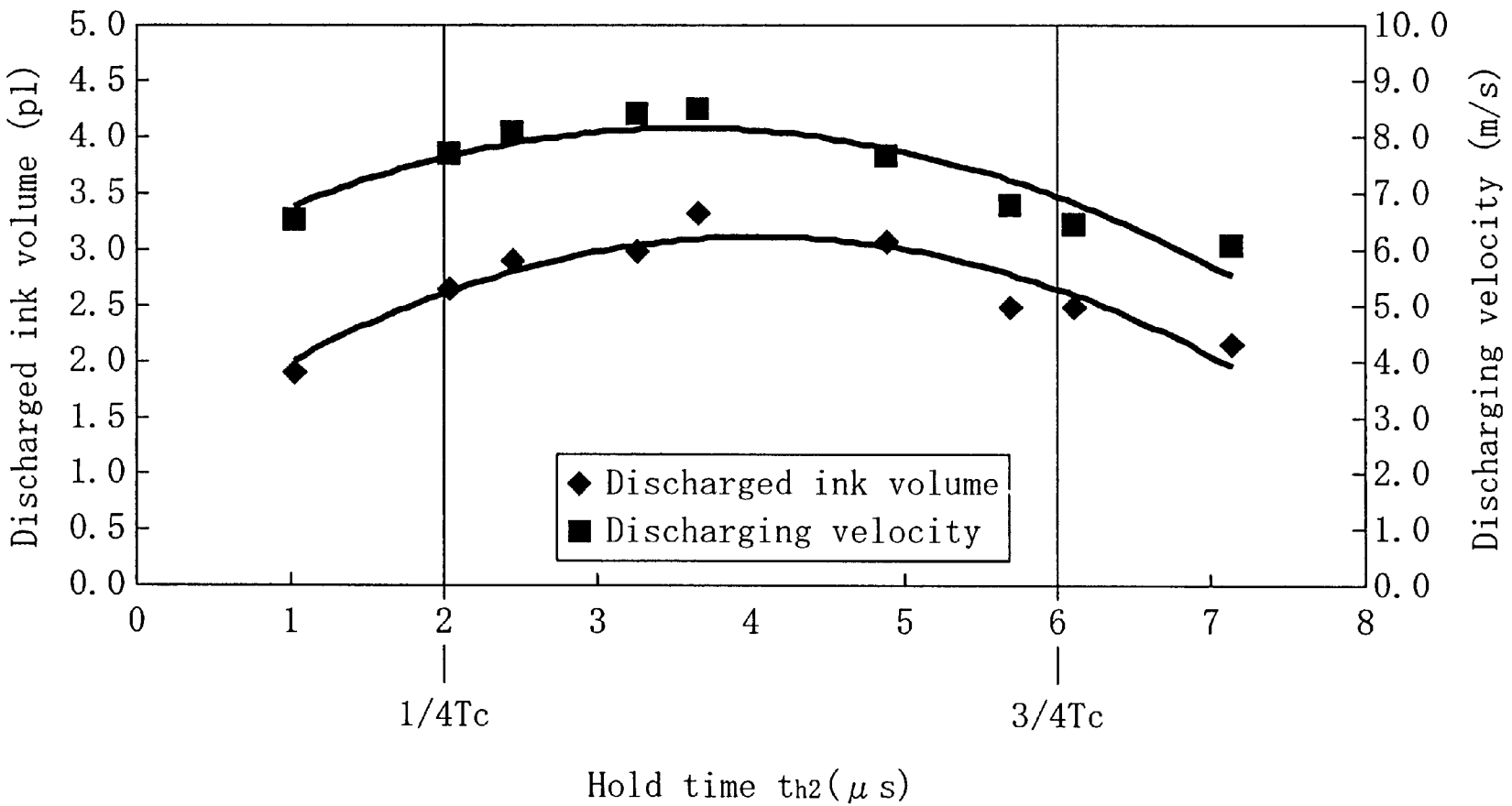
FIG. 11 is a graph illustrating the results of an experiment conducted for confirming the effect of increasing the discharged ink volume.

The results of the experiment are shown in FIG. 11. FIG. 11 is a graph in which the horizontal axis represents the time $t_{h2}$ between the auxiliary pulse signal P1 and the ink discharge pulse signal P2, the first vertical axis represents the discharged ink volume, and the second vertical axis represents the ink droplet discharging velocity. It can be seen from FIG. 11 that the discharged ink volume and the ink droplet discharging velocity both peak at a hold time $t_{h2}$ that is about ½ of the Helmholtz period Tc. It can also be seen that it is possible to obtain the effect of increasing the discharged ink volume by resonance when the hold time $t_{h2}$ is ¼ to ¾ of the Helmholtz period Tc. These results confirm the effect of the present embodiment.

Note that the waveform of the pulses is not limited to a trapezoidal waveform, but may alternatively be any other appropriate waveform such as a rectangular waveform, a triangular waveform, a sinusoidal waveform, etc.

Figure 12:
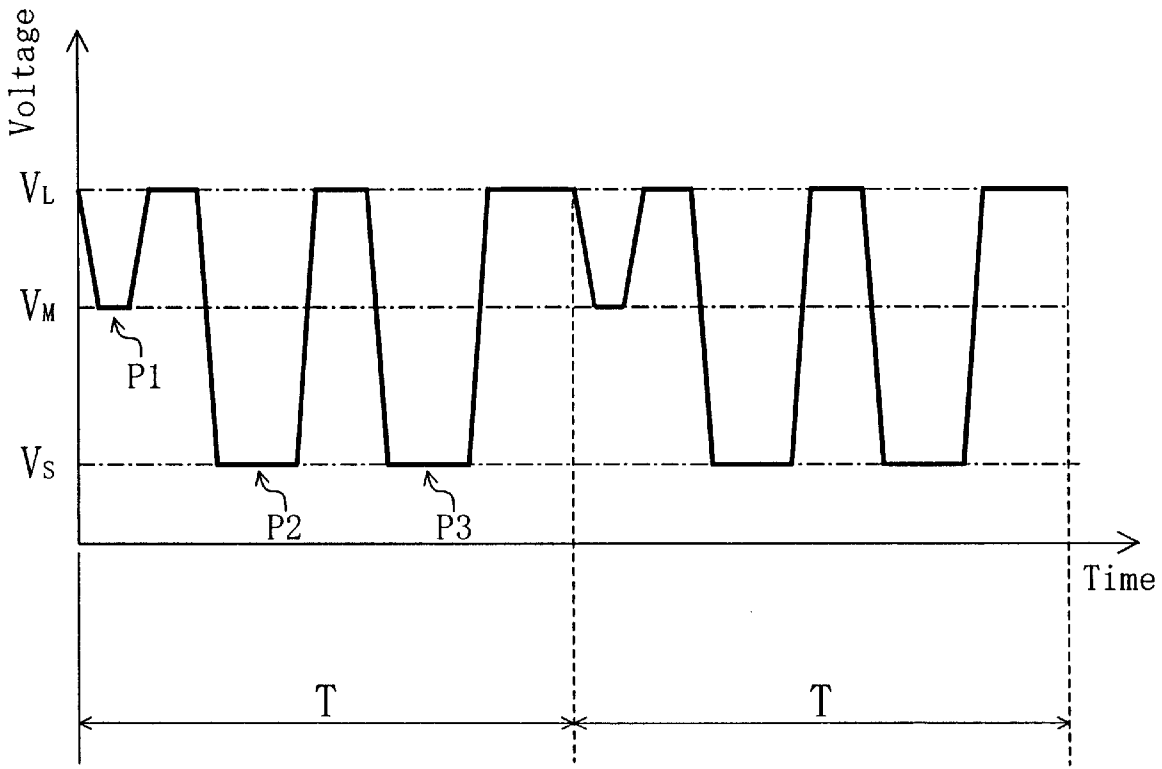
FIG. 12 is a waveform diagram illustrating a driving signal.

While the ink discharge pulse signal is made up of a single pulse signal P2 in the present embodiment, it may alternatively be made up of a plurality of pulse signals. For example, the ink discharge pulse signal may be made up of two pulse signals P2 and P3, as illustrated in FIG. 12.

The driving circuit 21 may either be provided separately from the ink jet head 1 or be provided in the ink jet head 1.

The present invention is not limited to the embodiment set forth above, but may be carried out in various other ways without departing from the spirit or main features thereof Thus, the embodiment set forth above is merely illustrative in every respect, and should not be taken as limiting. The scope of the present invention is defined by the appended claims, and in no way is limited to the description set forth herein. Moreover, any variations and/or modifications that are equivalent in scope to the claims fall within the scope of the present invention.

What is claimed is:

1. An ink jet recording apparatus, comprising:

a head body provided with a nozzle and a pressure chamber, which is communicated to the nozzle and is filled with ink;

an actuator provided in the head body and including a piezoelectric element and an electrode for applying a voltage across the piezoelectric element for applying a pressure on the ink in the pressure chamber; and a driving circuit for supplying an actuator driving signal to the electrode of the actuator, wherein:

in every printing cycle, the driving circuit always supplies an auxiliary pulse signal for driving the actuator to a degree such that the ink is not discharged; and if an ink discharge instruction signal instructing an ink discharge is received, the driving circuit supplies, after the auxiliary pulse signal is supplied, an ink discharge pulse signal for driving the actuator so that the ink is discharged and so that an ink meniscus vibration in the nozzle is resonant with that caused by the auxiliary pulse signal.

2. The ink jet recording apparatus of claim 1, wherein the ink discharge pulse signal is made up of a plurality of pulses.

3. The ink jet recording apparatus of claim 1, wherein each of the auxiliary pulse signal and the ink discharge pulse signal is a pulse signal for driving the actuator so as to first depressurize, and then pressurize, the pressure chamber.

4. The ink jet recording apparatus of claim 1, wherein a time T from a completion of the supply of the auxiliary pulse signal until a start of the supply of the ink discharge pulse signal is set to satisfy $$n*Tc+Tc/4 \leqq T \leqq n*Tc+3Tc/4,$$

where Tc is a Helmholtz period of a head, and n is zero or a natural number.

5. The ink jet recording apparatus of claim 1, wherein:

a pulse width of the auxiliary pulse signal is set to be ¼ to ½ of a Helmholtz period of a head; and a peak value of the auxiliary pulse signal is set to be less than or equal to a value that is 0.6 times that of the ink discharge pulse signal.

6. The ink jet recording apparatus of claim 1, further comprising:

an ink jet head including at least the head body and the actuator; and a driving mechanism for relatively moving the ink jet head and a recording medium with respect to each other.

7. An ink jet recording apparatus, comprising:

a head body provided with a nozzle and a pressure chamber, which is communicated to the nozzle and is filled with ink;

an actuator provided in the head body and including a piezoelectric element and an electrode for applying a voltage across the piezoelectric element for applying a pressure on the ink in the pressure chamber; and a driving circuit for supplying an actuator driving signal to the electrode of the actuator, wherein:

in every printing cycle, the driving circuit always supplies an auxiliary pulse signal for driving the actuator to a degree such that the ink is not discharged;

if an ink discharge instruction signal instructing an ink discharge is received, the driving circuit supplies, after the auxiliary pulse signal is supplied, an ink discharge pulse signal for driving the actuator so that the ink is discharged; and a time T from a completion of the supply of the auxiliary pulse signal until a start of the supply of the ink discharge pulse signal is set to satisfy $$n*Tc+Tc/4 \leqq T \leqq n*Tc+3Tc/4,$$

where Tc is a Helmholtz period of a head, and n is zero or a natural number.

8. The ink jet recording apparatus of claim 7, wherein the ink discharge pulse signal is made up of a plurality of pulses.

9. The ink jet recording apparatus of claim 7, wherein each of the auxiliary pulse signal and the ink discharge pulse signal is a pulse signal for driving the actuator so as to first depressurize, and then pressurize, the pressure chamber.

10. The ink jet recording apparatus of claim 7, wherein:

a pulse width of the auxiliary pulse signal is set to be ¼ to ½ of a Helmholtz period of a head; and a peak value of the auxiliary pulse signal is set to be less than or equal to a value that is 0.6 times that of the ink discharge pulse signal.

11. The ink jet recording apparatus of claim 7, further comprising:

an ink jet head including at least the head body and the actuator; and a driving mechanism for relatively moving the ink jet head and a recording medium with respect to each other.

* * * * *